US005395217A

United States Patent [19]

Hoffmann et al.

[11] Patent Number: 5,395,217

[45] Date of Patent: Mar. 7, 1995

[54] GEAR PUMP FOR OIL FOR AN INTERNAL-COMBUSTION ENGINE, IN PARTICULAR FOR MOTOR VEHICLES

[75] Inventors: Kurt Hoffmann, Bad Schussenried; Franz Maucher, Bad Walsee, both of Germany

[73] Assignee: Schwäbische Hüttenwerke GmbH, Germany

[21] Appl. No.: 234,594

[22] Filed: Apr. 28, 1994

Related U.S. Application Data

[63] Continuation of Ser. No. 893,819, Jun. 4, 1992, abandoned.

[30] Foreign Application Priority Data

Jun. 7, 1991 [DE] Germany ..... 41 18 872.1
Jul. 12, 1991 [DE] Germany ..... 41 23 190.2

[51] Int. Cl.[6] ..... F04B 17/00

[52] U.S. Cl. ..... 417/362; 417/364; 418/135; 418/171

[58] Field of Search ..... 417/362, 364, 380; 123/198 C; 418/166, 170, 171, 135

[56] References Cited

U.S. PATENT DOCUMENTS

| | | | |
|---|---|---|---|
| 1,486,836 | 3/1924 | Hill . | |
| 3,407,741 | 10/1968 | Weber et al. | 418/166 |
| 3,563,679 | 2/1971 | Richardson | 418/166 |
| 4,185,717 | 1/1980 | Ford, Jr. et al. | 418/171 |
| 4,295,807 | 10/1981 | Kruger | 417/362 |
| 4,518,332 | 5/1985 | Saegusa | 418/171 |
| 4,540,347 | 9/1985 | Child | 418/171 |
| 4,827,881 | 5/1989 | Baker et al. . | |
| 4,976,595 | 12/1990 | Taniguchi | 418/171 |

FOREIGN PATENT DOCUMENTS

| | | | |
|---|---|---|---|
| 566247 | 4/1923 | France . | |
| 3 022 419 A | 12/1981 | Germany . | |
| 36 03 773 A | 7/1987 | Germany . | |
| 3603773 A | 9/1987 | Germany . | |
| 183583 | 11/1982 | Japan | 418/166 |
| 2100354A | 6/1982 | United Kingdom . | |
| 2223275 | 4/1990 | United Kingdom | 418/171 |
| 0467571A | 5/1991 | United Kingdom . | |

*Primary Examiner*—Richard A. Bertsch
*Assistant Examiner*—Roland G. McAndrews, Jr.
*Attorney, Agent, or Firm*—Armstrong, Westerman, Hattori, McLeland & Naughton

[57] ABSTRACT

The invention relates to a gear pump for oil for an internal-combustion engine, in particular for motor vehicles, comprising a pump housing mounted on the motor and an outer rotor which is arranged in the pump housing, an inner rotor additionally being arranged within the outer rotor or within the pump housing and at least one suction and/or at least one pressure passage being provided in the pump housing, a drive further being present; the pump according to the invention is integrated in a drive wheel or guide pulley of the internal-combustion engine and the outer rotor or the outer rotors are driven by the drive wheel or the guide pulley.

15 Claims, 7 Drawing Sheets

GEAR PUMP FOR OIL FOR AN INTERNAL-COMBUSTION ENGINE, IN PARTICULAR FOR MOTOR VEHICLES

This application is a continuation of application Ser. No. 07/893,819, filed Jun. 4, 1992, now abandoned.

BACKGROUND OF THE INVENTION

1. Field of the Invention

The invention relates to a gear pump for oil for an internal-combustion engine, in particular for motor vehicles, comprising a pump housing mounted on the motor, an outer rotor arranged in the pump housing, an inner rotor arranged in the outer rotor or the pump housing, at least one suction passage and/or at least one pressure passage in the pump housing, and a drive.

2. Description of the Prior Art

Pumps of this type are employed in a great variety of technical fields. However, gear pumps of this type are being increasingly used for internal-combustion engines, in particular motor vehicle internal-combustion engines, usually piston engines. For this purpose, the crankshaft is extended at its free end to drive the inner rotor or outer rotor. The inner rotor or driven outer rotor may be driven directly by the free end of the crankshaft. However, constructional forms are also known in which the inner rotor is located on a separate bearing collar formed in the housing of the pump. The collar is traversed by the crankshaft and driven via a catch.

As can be the case in the pump of the present invention, the flow direction extends in a feed passage approximately tangentially to the average peripheral direction of the pump gears in the so-called suction kidney area. Accordingly, the projection of the flow direction in the feed passage at the start of the area in which said passage merges into the suction kidneys, i.e. in the region of the inlet opening of the working chamber, onto a plane normal to the pump axis has a direction which substantially coincides with the movement direction of the teeth of the inner rotor and/or outer rotor in said region.

As also possible in the pump of the present invention, in the known oil pumps the feed passage, which at the connection of the oil suction tube may have the same circular cross-section as said oil suction tube, extends with tapering circular cross-section up to the beginning of the suction kidney. From there, the oil feed passage extends partially in front of the end wall of the working chamber and partially over the peripheral surface of the working chamber. The oil flow therefore flows not only around the end face of the outer rotor but also over part of the peripheral surface of the outer rotor. The suction kidney, i.e. the region of the opening of the working chamber, also extends over the end wall and the periphery thereof.

On the other hand, it is possible to choose a configuration for the suction kidney with which the oil flow no longer comes into contact with the peripheral surface of the outer rotor. Here, the arrangement of the suction kidney is provided only in one end wall of the working chamber.

However, in the prior art only gear pumps or internal rotor gear pumps for oil for motor vehicle internal-combustion engines are known which are provided as separate pumps and must be also separately driven.

However, this necessarily involves branching off drive energy from the engines connected to the known pumps, resulting in power losses. Also, additional space must be provided for the oil pumps.

SUMMARY OF THE INVENTION

The present invention is therefore based on the problem of remedying the disadvantages of the prior art and in particular proposing a compact and simple solution for a gear pump for oil for internal-combustion engines.

The invention therefore proposes in a gear pump for oil for an internal-combustion engine, in particular for motor vehicles, comprising a pump hub mounted on the motor, an outer rotor arranged in the pump hub, an inner rotor arranged in the outer rotor and/or the pump hub, at least one suction passage and/or at least one pressure passage in the pump hub, and a drive, the improvement in which the pump is arranged in a drive wheel or a guide pulley of the internal-combustion engine and the outer rotor or outer rotors is or are driven by the drive wheel or the guide pulley.

The invention provides that the gear pump is arranged in a drive wheel or gear present on the engine or in a guide pulley present there. The pump gears provided for the actual pumping operation or the pump gear provided for that purpose are driven via the drive wheel or gear present in any case on the engine or the guide pulley likewise present.

By integrating the gear pump according to the invention into a drive gear or wheel already present on the motor or into an already present guide pulley the following advantages are achieved, of the subsidiary claims: Compared with conventional solutions substantially less power is required and lower friction losses occur. In addition, no additional constructional space is needed because the pump according to the invention can be integrated within the guide pulley or the drive wheel. Moreover, the drive via the outer rotor gives a faster transmission ratio and consequently the gear set can have smaller dimensions. This likewise gives a more economical production, requiring less individual parts and less expenditure on assembly.

According to the invention the camshaft or the crankshaft of the internal-combustion engine can be used for the drive of the drive gear or wheel. A guide pulley present on the motor and usable according to the invention to accommodate the pump according to the invention can be set in motion via a toothed belt, a chain or a pinion. To compensate a necessary axial movement of the drive shaft (camshaft or crankshaft), a compensation plate can be provided in the drive wheel or gear which is connected to the drive shaft.

The compensation plate should be arranged between the drive wheel and the pump gears or the pump hub. To avoid rotation of the compensation plate or the outer rotor freely with respect to the drive wheel and at the same time permit a movement aligned coaxially with the drive or crankshaft, a guide means should be provided configured, for example, in the form of a cylindrical pin. To ensure that any compensation plate present is in permanent contact with the pump gears conveying the fluid, a spring means is provided which biases the compensation plate against the pump gears or presses them against the latter. In this manner, a constant displacement can be guaranteed independently of the axial movement of the drive shaft. If the latter were not obtained, pressure fluctuations would result or the conveying pressure would at times even break down completely.

Instead of the compensation plate, one of the pump gears could also be constructed to correspond to the function of the compensation plate.

The camshaft or crankshaft should be sealed with respect to the drive wheel or gear by means of a seal, in particular an O-ring seal. This avoids oil losses.

Between the camshaft or crankshaft and the pump hub and, in particular, the compensation plate an air gap should be present in which the drive shaft can rotate freely.

If the pump according to the invention is provided in a guide pulley provided on an internal-combustion engine, at least the outer rotor should be fixedly connected to the guide pulley. For this purpose the outer rotor can be pressed into the guide pulley. The outer rotor meshes with the inner rotor and can cooperate with the latter in the manner of a so-called Eaton pump.

In contrast, the inner rotor should be arranged slidingly on the pump hub so that it can execute the necessary rotation movements.

The guide pulley is mounted on the engine via a bearing pin. The bearing pin is however mounted or held on the engine by a ball-bearing. Between the pump hub and the bearing pin a further bearing, in particular a needle bearing, is provided.

This embodiment has the advantages that an outer rotor sliding bearing is completely dispensed with because the mounting can be effected via the guide pulley by the bearing pin mounted in a rolling bearing. This makes it possible to reduce friction power losses by about 50%. In addition, the outer rotor is braked only on one side via an axial friction surface.

Finally, at the engagement surface of the guide pulley towards the inner rotor a favorable relative rotational speed is obtained so that, in conjunction with the reduced friction losses referred to above, a saving of approximately 60% can be achieved compared with the known solutions.

To ensure the sealing of the pump according to the invention, between the drive wheel or the guide or deflection pulley and the pump hub a seal is provided. For this purpose, shaft sealing rings are usually employed.

In all constructional forms the gear pump according to the invention is driven parasitically externally. In the embodiment having a drive wheel, the force transmission is via the camshaft or the crankshaft to the drive wheel and from there via guide means present, for example, cylindrical pins, to the outer rotor. In contrast, in the prior art, the force transmission is provided by a drive shaft which is especially lengthened or provided for the pump. In the variant with the guide pulley the drive path runs similarly, although in slightly modified form because no forces are transmitted via the bearing pin and the outer rotor can be fixedly clamped into the drive wheel.

BRIEF DESCRIPTION OF THE DRAWINGS

The invention will be explained hereinafter with reference to preferred embodiments. Further features according to the invention and advantages of the present invention will become apparent. In the drawings.

DESCRIPTION OF THE PREFERRED EMBODIMENTS

Figure 1:
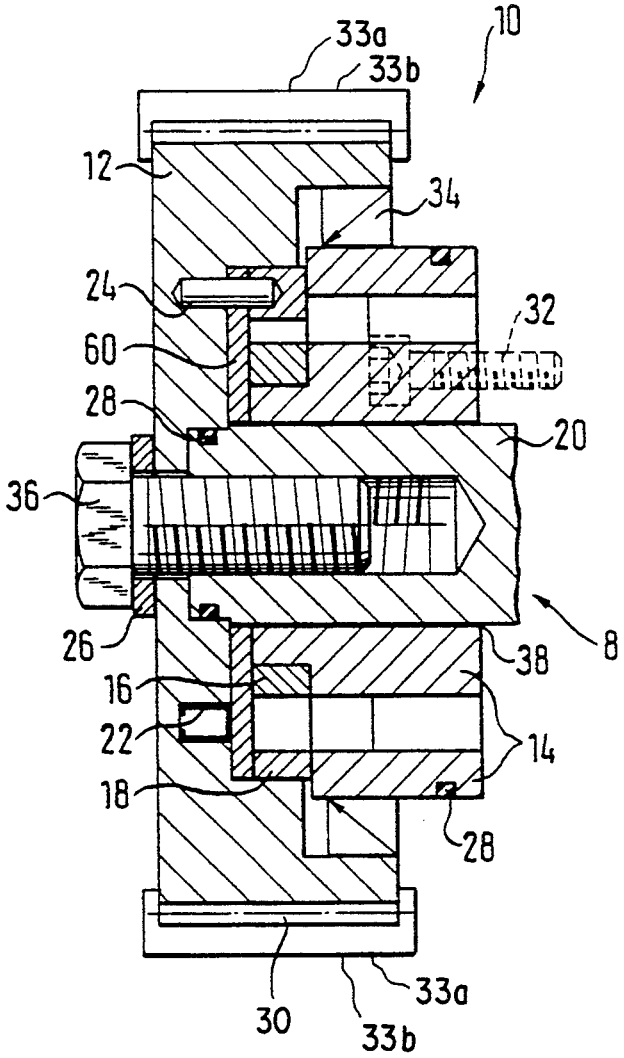
FIG. 1 is an axial section through a gear pump according to the invention provided with a drive wheel.

In FIG. 1 the gear pump for oil for an internal-combustion engine according to the present invention, in particular for motor vehicles, is denoted generally by the reference numeral 10. In the region 8 an internal-combustion engine is provided to which the pump according to the invention is secured via securing means 32, for example, screws, rivets or bolts. From the internal-combustion engine 8 the crankshaft 20 projects and to the latter a drive wheel or gear 12 is secured via a screw 36. Between the screw 36 and the drive wheel 12 a washer or spring ring 26 may be provided. The crankshaft 20 is sealed with respect to the drive wheel 12 via an O-ring seal 28. Usually, teeth 30 are provided at the outer periphery of the drive wheel 12 and via said teeth for example, a toothed belt 33*a* or chain 33*b* can be driven. An air gap 38 is provided between the crankshaft 20 and a pump hub 14. In this manner the crankshaft 20 can rotate freely within the pump hub which is fixedly connected to the engine block.

In the general sectional illustration the suction or pressure opening of the gear pump according to the invention, can be seen. A shaft seal 34 seals the pump hub 14 with respect to the drive wheel 12.

A compensation plate 60 is provided for compensating the axial movement of the crankshaft 20. The plate 20 is provided between the drive wheel 20 and the outer rotor 18, the inner rotor 16 and the pump hub 14. The inner rotor 16 is usually mounted to be freely rotatable. The compensation plate also executes the movements of the crankshaft 20 coaxially to the latter. The compensation plate is guided thereby on guide means 24, in the present case cylindrical pins 24, which are mounted at least partially displaceably in the adjacent components. The outer rotor 18 is driven via said cylindrical pins 24 with which the outer rotor 18 is non-rotatably connected to the drive wheel 12. The compensation plate 60 is held by a spring means 22 in permanent contact with the pump gears 16, 18.

The outer rotor 18 meshes with the inner rotor 16 and cooperates with the latter in the manner of an Eaton pump.

In the present embodiment the following force transmission path results: The crankshaft 20 drives the drive wheel 12 which in turn rotates the outer rotor 18 via the cylindrical pins 24. Instead of the cylindrical pins 24 the inner rotor 18 could be provided with a ridge or groove which has a corresponding counterpart in the drive wheel 12. Via its toothing the outer rotor 18 entrains the inner rotor 16.

Figure 2:
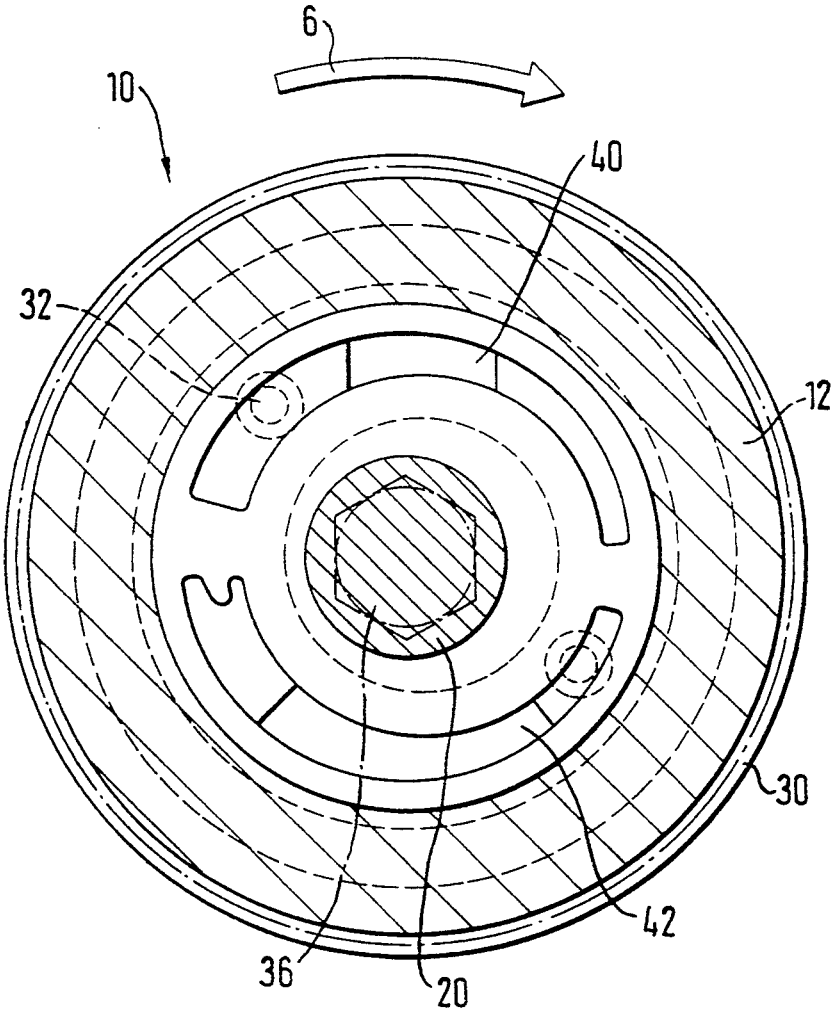
FIG. 2 is a cross-section through the pump according to the invention as shown in FIG. 1.

The cross-section through the gear pump 10 shown in FIG. 2 illustrates the inlet and outlet openings 40, 42 through which the oil to be pumped is inspired and expelled. In addition, the securing members 32 can be seen. In the center, the crankshaft 20 and/or the screw 36 holding the drive wheel 12 is provided. The rotational movement in the present case is indicated by the arrow 6 and is clockwise.

Figure 3:
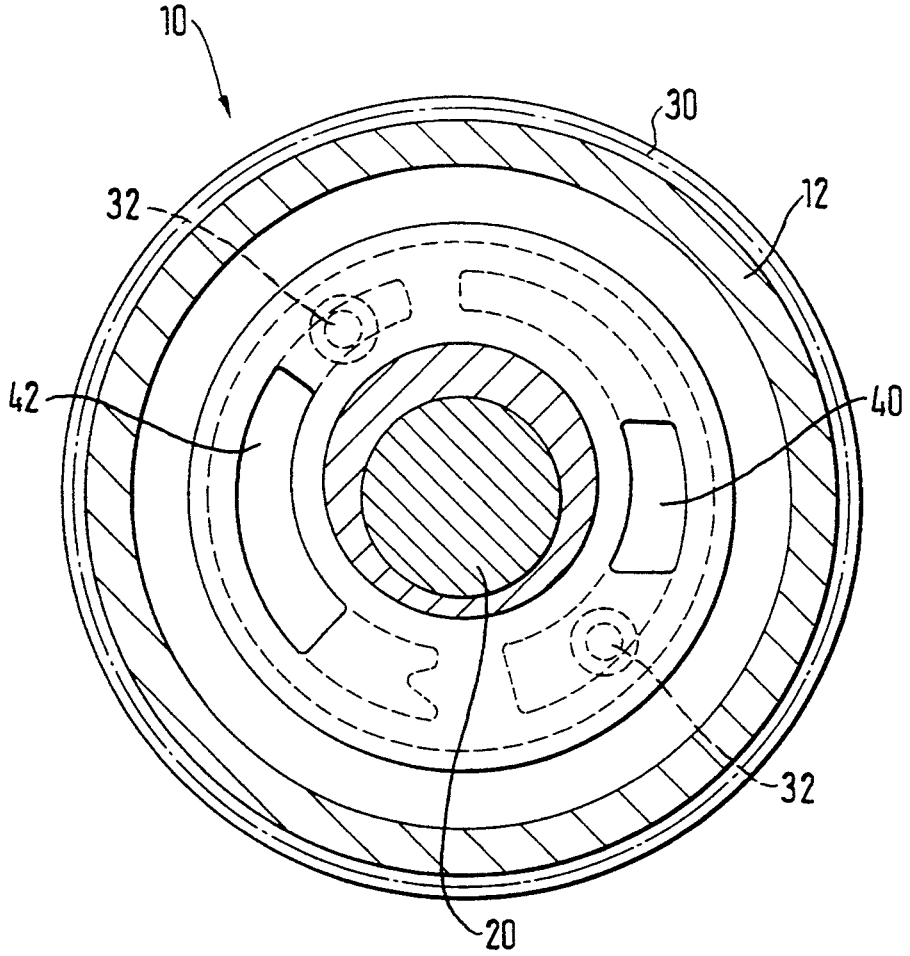
FIG. 3 is a cross-section through the pump according to the invention as shown in FIG. 1 in another plane.

FIG. 3 illustrates an analogous view of the features shown in FIG. 2.

Figure 4:
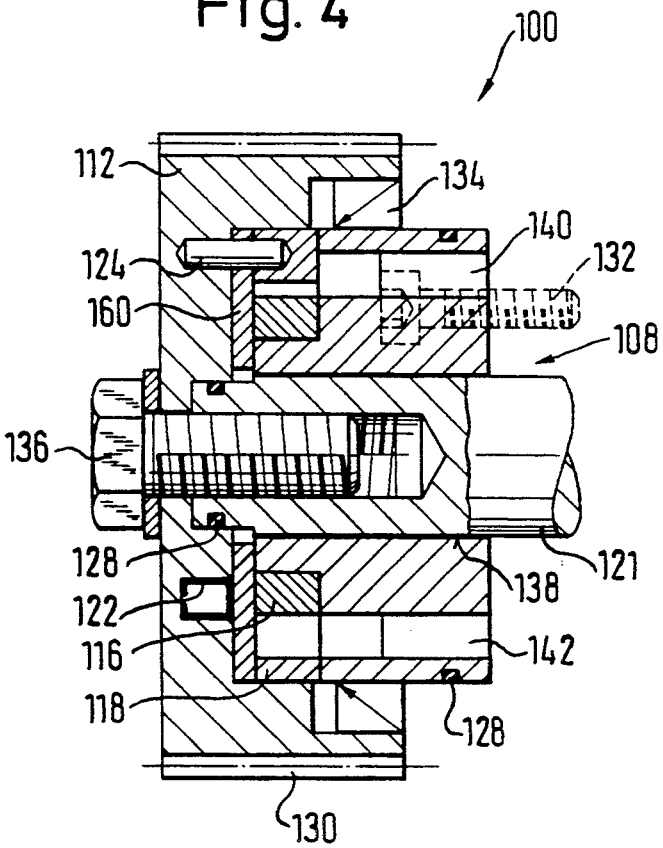
FIG. 4 is an axial longitudinal section through a further embodiment analogous to the embodiment of FIG. 1.

The embodiment illustrated in FIG. 4 has the same features as the embodiment according to FIG. 1, 100 being added to the reference numerals of FIG. 1. However, instead of the crankshaft 20 (FIG. 1) a camshaft 121 is provided which is usually of smaller diameter than a crankshaft. The oil to be pumped is introduced or sucked into the pump according to the invention via an inlet opening 142 and is conveyed between the outer rotor 118 having a variable inner diameter and the inner rotor 116 to the pressure or exit opening 140. The pressures obtainable are between 1 and 5 bar but can be further influenced by constructional steps. Both the pressure obtainable and the delivery rate depend on the speed of rotation. As a rule, the delivery pressure obtainable decreases with decreasing speed. On the other hand, the oil delivery rate increases with the speed. The necessary amounts of oil can be achieved using different gear set types. With the performance values of the pump according to the invention indicated above, remarkable reductions of the friction losses are achieved, thereby giving outstanding advantages.

Figure 5:
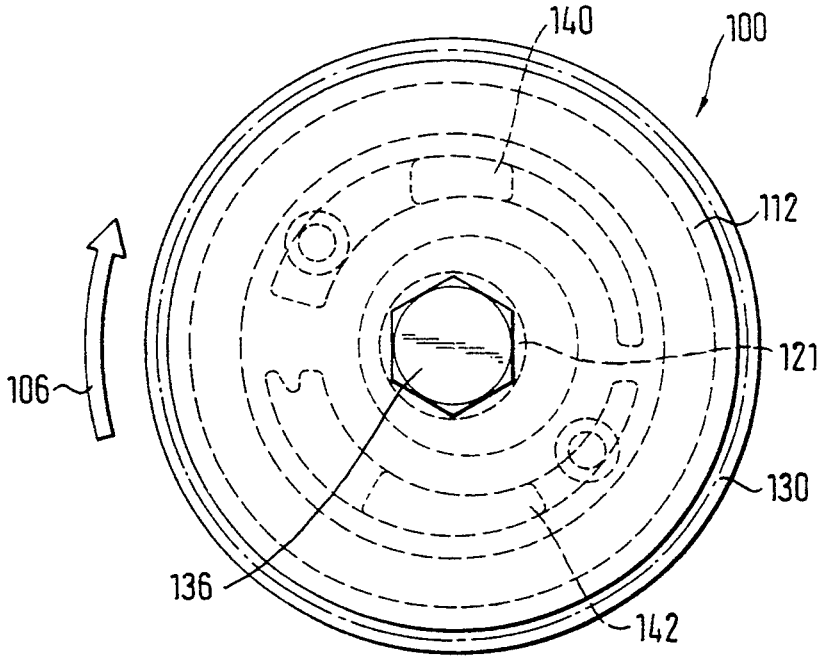
FIG. 5 is a cross-section through the embodiment according to FIG. 4.
Figure 6:
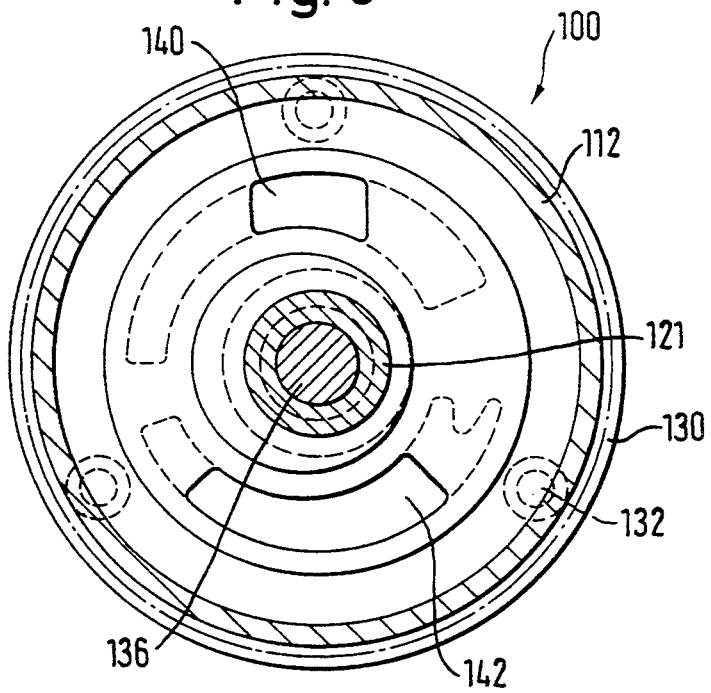
FIG. 6 is a cross-section through the embodiment according to FIG. 4 in another plane.

FIG. 5 shows a cross-section through the embodiment according to FIG. 4. In this Figure the suction and pressure openings are indicated by the reference numerals 140,142. The respective embodiment 100 likewise delivers clockwise in the direction of the arrow 106. FIG. 6 shows the same features as FIG. 5 but in another sectional plane.

Figure 7:
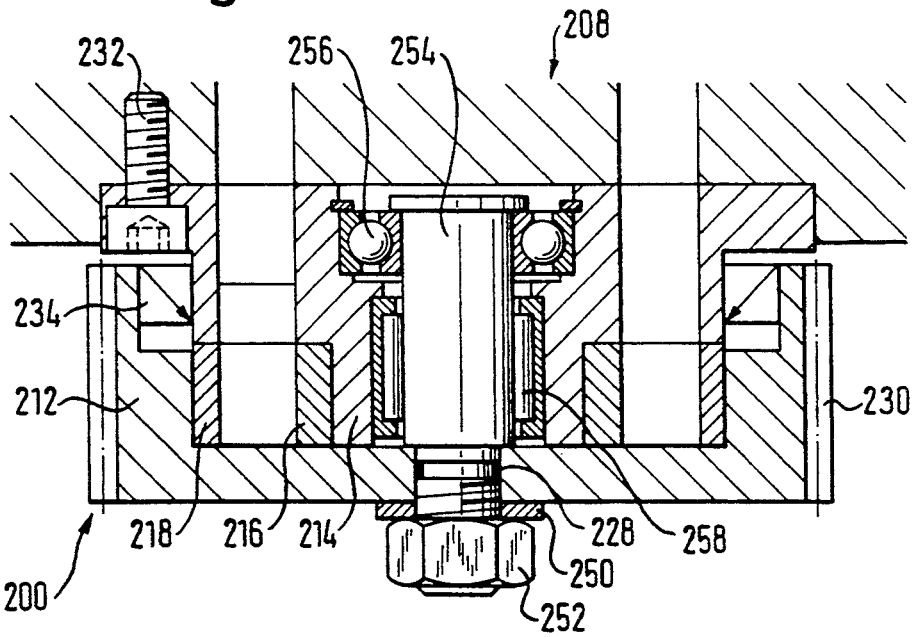
FIG. 7 is an embodiment according to the invention which is arranged in a guide or deflection pulley, shown in longitudinal section.

In FIG. 7 an embodiment is shown in which the pump according to the invention is driven by a given guide pulley 212 which is provided with an outer toothing 230. In the embodiment according to FIG. 7, denoted generally by the reference numeral 200, a camshaft or crankshaft projecting from the engine block is therefore not necessary. The illustrated embodiment 200 comprises a pump housing 214 which can be made from aluminium. An inner rotor 216, advantageously consisting of sintered material, slides directly on the pump housing 214. Within the pump housing 214 a bearing pin 254 is guided and is mounted via a needle bearing 258. The bearing pin 254 is rotatably mounted on the engine block 208 via the pump housing 214 and a ball-bearing 256 disposed therebetween. The pump housing is connected to the engine block 208 via securing means 232, i.e. a cylindrical screw.

Between the guide pulley 212 and the pump housing 214 a seal 234 is disposed, a shaft seal ring usually being employed. The outer rotor 218 is pressed into the guide or deflection pulley 212.

In the right section half of FIG. 7 the suction opening is illustrated and in the left section half the pressure opening can be seen.

In the embodiment 200 according to FIG. 7 the frictional losses are considerably reduced compared with known gear pumps, i.e. by about 60%. By mounting the guide pulley 212 via the bearing pin 254 mounted in a rolling bearing the necessary frictional power is reduced by 50%. Further reductions in frictional losses are obtained by the smaller axial frictional area as well, said area engaging only on one side the outer rotor, and by the positively changed relative speed between the inner rotor and the guide pulley 212, giving a total of 60% more favorable power efficiency than in the prior art. Corresponding advantages can also be obtained for the embodiments 10 and 100.

Figure 9:
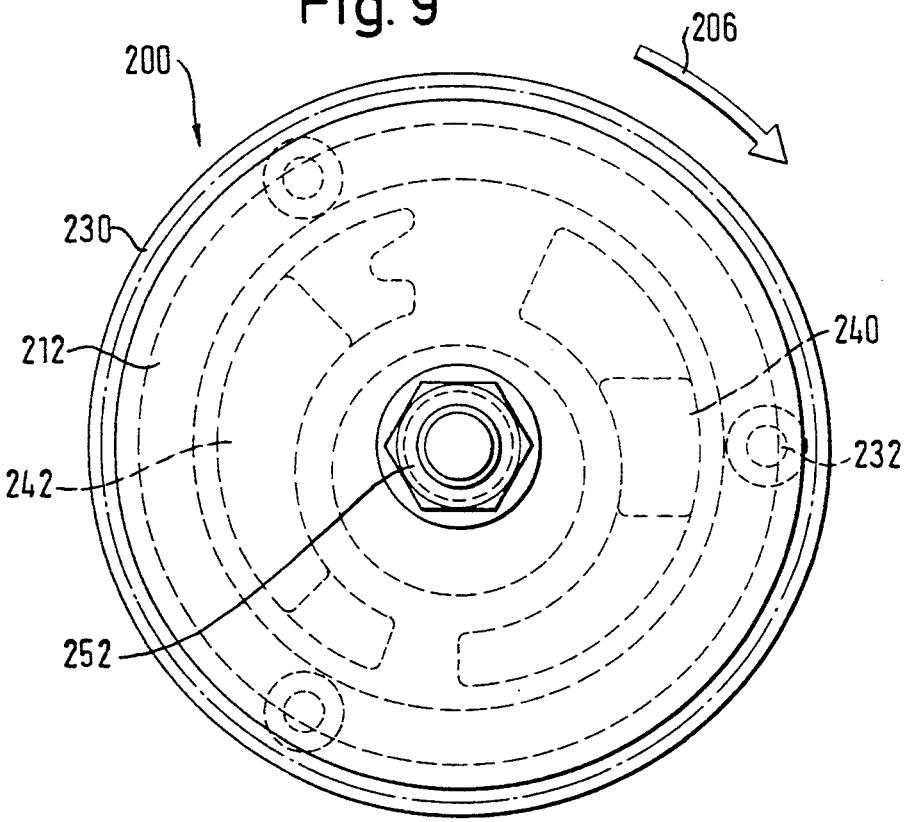
FIG. 9 is a cross-section through the embodiment according to FIG. 7 in another plane.
Figure 8:
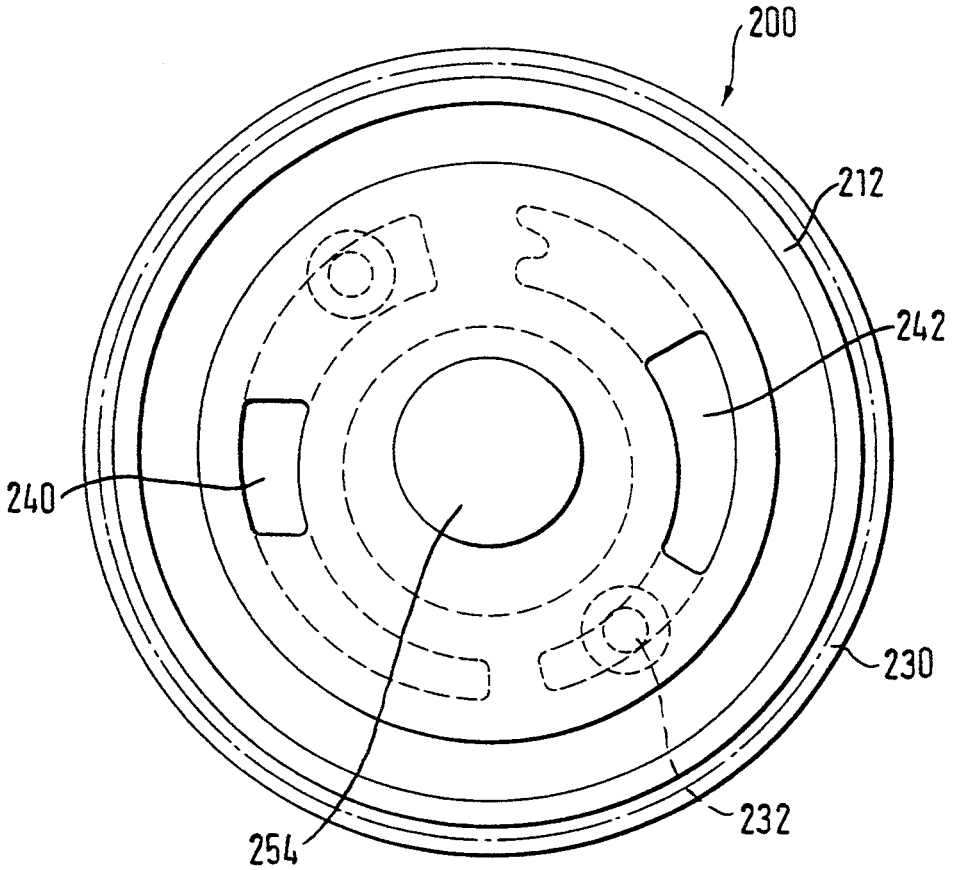
FIG. 8 is a cross-section through the embodiment according to the invention of FIG. 7

FIGS. 8 and 9 show cross-sections through the embodiment 200 which illustrate the suction and pressure supplies and the associated compression and decompression chambers. With regard to the possible suction kidney forms attention is drawn to the introduction to the description.

We claim:

1. A gear pump for pumping oil in an internal-combustion engine, in particular for motor vehicles, comprising:

a pump hub mounted on an engine block of said engine;

an outer rotor arranged outside the pump hub;

an inner rotor arranged between the outer rotor and the pump hub;

at least one suction passage and at least one pressure passage formed by said inner rotor, said outer rotor and said pump hub; and a guide pulley coaxially mounted on the engine via a rolling-mounted bearing pin;

wherein the pump is arranged within said guide pulley, and wherein said outer rotor is driven by said guide pulley.

2. A pump according to claim 1, wherein the drive device comprises a guide pulley for driving a toothed belt.

3. A pump according to claim 1, wherein the bearing pin is supported on the engine via a ball-bearing.

4. A pump according to claim 1, wherein the guide pulley is driven by a chain.

5. A pump according to claim 1, wherein the outer rotor is fixedly connected to the guide pulley.

6. A pump according to claim 5, wherein the outer rotor is connected to the guide pulley via a pressed fit.

7. A pump according to claim 1, wherein between the pump housing, the inner rotor and the bearing pin a further bearing is arranged.

8. A pump according to claim 7, wherein said further bearing comprises a needle bearing.

9. A pump according to claim 1, further comprising a sealing means for sealing the bearing pin from the guide pulley.

10. A pump according to claim 9, wherein said sealing means comprises an O-ring seal.

11. A gear pump for pumping oil in an internal combustion engine, in particular, for motor vehicles, comprising:

a pump hub mounted on an engine block of said engine;

an outer rotor arranged outside the pump hub;

an inner rotor arranged between the outer rotor and the pump hub;

at least one suction passage and at least one pressure passage formed by said inner rotor, said outer rotor and said pump hub;

a drive device coaxially mounted on and driven by a rotatable shaft extending from said engine block;

a compensation plate provided between the drive device, the outer rotor, the inner rotor and the pump hub; and at least one guide means for guiding the compensation plate coaxially to the drive device, the guide means being held in the outer rotor and the drive device, wherein the pump is arranged within said drive device and said outer rotor and is driven by said drive device.

12. A gear pump for pumping oil in an internal combustion engine, in particular, for motor vehicles, comprising:

a pump hub mounted on an engine block of said engine;

an outer rotor arranged outside the pump hub;

an inner rotor arranged between the outer rotor and the pump hub;

at least one suction passage and at least one pressure passage formed by said inner rotor, said outer rotor and said pump hub;

a drive device coaxially mounted on and driven by a camshaft extending from said engine block;

an O-ring seal forming a seal between the camshaft and the drive device, wherein the pump is arranged within said drive device and said outer rotor and is driven by said drive device.

13. A gear pump for pumping oil in an internal combustion engine, in particular, for motor vehicles, comprising:

a pump hub mounted on an engine block of said engine;

an outer rotor arranged outside the pump hub;

an inner rotor arranged between the outer rotor and the pump hub;

at least one suction passage and at least one pressure passage formed by said inner rotor, said outer rotor and said pump hub;

a drive device coaxially mounted on and driven by a rotatable shaft extending from said engine block; and a shaft ring seal arranged between the pump hub and the drive device, wherein the pump is arranged with said drive device and said outer rotor and is driven by said drive device.

14. A gear pump for pumping oil in an internal combustion engine, in particular, for motor vehicles, comprising:

a pump hub mounted on an engine block of said engine;

an outer rotor arranged outside the pump hub;

an inner rotor arranged between the outer rotor and the pump hub;

at least one suction passage and at least one pressure passage formed by said inner rotor, said outer rotor and said pump hub;

a drive device coaxially mounted on and driven by a crankshaft extending from said engine block;

an O-ring seal forming a seal between the crankshaft and the drive device, wherein the pump is arranged with said drive device and said outer rotor and is driven by said drive device.

15. A liquid pump comprising a cup-shaped drive wheel, a stationary hub, a shaft rotatably supported within the hub and affixed to the drive wheel to support the drive wheel for rotation with respect to the hub, the drive wheel being formed with a recess on the side toward the hub to receive the hub within the recess, and at least two pump wheels disposed within the recess between the drive wheel and the hub, one of the pump wheels being disposed on the inner peripheral surface of the cup-shaped drive wheel and another pump wheel being disposed on an opposed surface of the hub.

* * * * *